United States Patent [19]

Fontaine

[11] 4,359,808

[45] Nov. 23, 1982

[54] ADJUSTABLE LENGTH STRAP WITH NON-EXPANSIBLE NON-METALLIC STRAP MEMBERS INTERCONNECTED BY A METALLIC COUPLING DEVICE

[75] Inventor: Raymond C. Fontaine, Greenville, R.I.

[73] Assignee: Textron, Inc., Providence, R.I.

[21] Appl. No.: 116,157

[22] Filed: Jan. 28, 1980

[51] Int. Cl.[3] ..... A44B 11/25

[52] U.S. Cl. ..... 24/71 R; 24/71 J; 24/241 PP; 24/265 WS; 24/319

[58] Field of Search ..... 24/71 R, 71 J, 71 ST, 24/316, 318, 319, 265 WS, 241 PP

[56] References Cited

U.S. PATENT DOCUMENTS

| | | | |
|---|---|---|---|
| 1,406,517 | 2/1922 | Wood | 24/318 |
| 1,742,464 | 1/1930 | Eklund | 24/265 WS |
| 1,750,133 | 3/1930 | Roy | 24/71 J |
| 2,229,677 | 1/1941 | Schoeninger . | |
| 2,273,218 | 2/1942 | Prestinari . | |
| 2,363,872 | 11/1944 | Kiessling | 24/170 |
| 2,518,716 | 8/1950 | Prestinari et al. | 24/241 PP |
| 3,478,537 | 11/1969 | Golberine et al. | 24/265 WS |
| 3,636,596 | 1/1972 | Lizuka | 24/265 WS |
| 3,664,559 | 5/1972 | Bruner | 24/241 PP |
| 3,685,107 | 8/1972 | Epiard | 24/265 WS |
| 3,735,455 | 5/1973 | Hauser | 24/191 |
| 3,795,028 | 3/1974 | Weiss . | |
| 4,198,732 | 4/1980 | Rieth et al. . | |

FOREIGN PATENT DOCUMENTS

| | | | |
|---|---|---|---|
| 2038917 | 8/1979 | United Kingdom | 24/265 WS |

*Primary Examiner*—Victor N. Sakran

*Attorney, Agent, or Firm*—Thompson, Birch, Gauthier & Samuels

[57] ABSTRACT

A strap for attaching a watch or other jewelry article to the wrist of a wearer, including non-expansible non-metallic strap members interconnected by a metallic coupling device. The coupling device is adapted to accommodate adjustment or variation of the overall length of the strap to suit the requirements of the wearer. At least one of the strap members has a strap adaptor permanently secured thereto, with at least one tab member protruding therefrom. A connector element on the metallic coupling device has an aperture, notch or the like into which the tab member is received before being bendably deformed to overlap and detachably secure the coupling device to the aforesaid strap member.

18 Claims, 23 Drawing Figures

ADJUSTABLE LENGTH STRAP WITH NON-EXPANSIBLE NON-METALLIC STRAP MEMBERS INTERCONNECTED BY A METALLIC COUPLING DEVICE

BACKGROUND OF THE INVENTION

The present invention relates generally to a strap for attaching a watch or other jewelry article to the wrist of a wearer, and in particular to a strap which includes non-metallic non-expansible strap members interconnected by a metallic coupling device which is adapted to accommodate adjustment or variation of the overall strap length to suit the requirements of the wearer.

Such non-metallic strap members are prone to wear more rapidly than those made of metal, and thus they must be replaced more frequently. However, in the past, such replacements have often entailed replacement of the metallic coupling devices, even though the coupling devices were relatively unworn and still entirely serviceable. This was due to the fact that the coupling devices were permanently attached to at least one of the non-metallic strap members, thus making replacement of one without the other difficult if not impossible. This premature replacement of the metallic coupling devices has been wasteful and costly, particularly when precious metals are involved.

In other known arrangements, coupling devices such as clasps or buckles have been separably connected to non-metallic straps by detachable connectors such as spring bars. However, such connectors often compromise the overall appearance of the assembly by failing to provide a continuous decoratively blended look.

SUMMARY OF THE INVENTION

A primary objective of the present invention is the provision of an improved strap wherein non-expansible non-metallic strap members are associated with a metallic coupling device in a manner such that when the strap members become worn, they may be readily and conveniently disassociated from the coupling device, which then can be reused with another set of replacement strap members. In several of the embodiments of the invention hereinafter to be described in greater detail, the strap members are interconnected by a coupling device in the form of a metallic clasp. The clasp includes a clamp assembly slidable lengthwise on and fixable at selected locations along a first strap member, and a hook assembly separably connected to the clamp assembly. A metallic strap adaptor is permanently secured to a second strap member, preferably at one end thereof. The adaptor has at least one tab member protruding therefrom. A connector element on the coupling assembly has at least one aperture, notch or the like into which the tab member is received before being bendably deformed to overlap and detachably secure the hook assembly to the second strap member. When replacement of the strap members becomes necessary, the clamp assembly is slidably removed from the first strap member and the hook assembly is detached from the second strap member by prying up each tab member and withdrawing it from its associated aperture or notch in the connector element. Replacement strap members are then substituted. The clamp assembly is slidably mounted and fixed along the length of the first replacement strap member. The second replacement strap member includes an identical metallic strap adaptor which can be reconnected with the hook assembly in the above-described manner.

In another embodiment of the invention, the coupling device consists of a short section of metallic expansible linkage. In this case, each strap member carries a strap adaptor with protruding tab members bendably cooperating with connector elements at opposite ends of the linkage section. Here again, the tab members can be pried up and disconnected, thereby enabling the linkage section to be reused with replacement strap members.

It will thus be appreciated that with the present invention, when the non-metallic strap members become worn, they may be readily disassociated from the metallic coupling devices, and the coupling devices can then be reused with replacement strap members. Any loss of metallic components is limited to the metallic strap adaptors, which is of no consequence, since they are small inexpensive pieces, preferably thin stampings.

Other objects of the present invention include the provision of a connection between the metallic coupling device and each associated strap member which is neat and secure, with the major portion of each strap adaptor being completely enveloped by the strap material.

Still another object of the present invention is the provision of metallic coupling devices which can be reattached to non-metallic replacement straps without having to resort to the use of elaborate tools and fixtures.

Other objects and advantages will become more apparent as the description proceeds with the aid of the accompanying drawings.

Another object of the present invention is the provision of a readily separable connection between a non-metallic strap and a metallic coupling device which provides a continuous decoratively blended look.

DETAILED DESCRIPTION OF INVENTION

Figure 1:
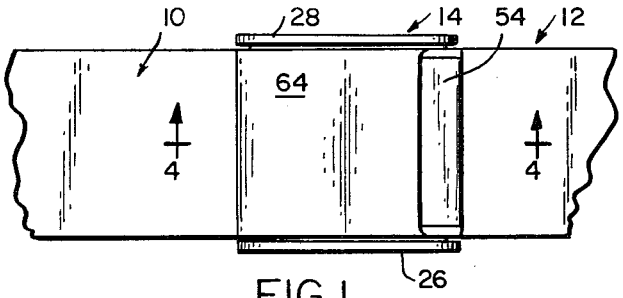
FIG. 1 is a partial top plan view of one embodiment of a strap in accordance with the present invention.
Figure 2:
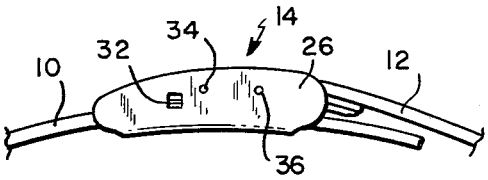
FIG. 2 is a side elevational view of the strap shown in FIG. 1.
Figure 3:
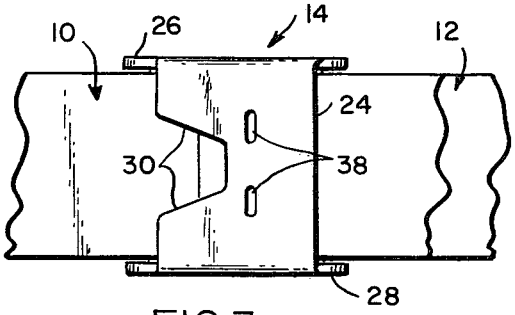
FIG. 3 is a bottom plan view of the strap shown in FIGS. 1 and 2.

Referring initially to FIGS. 1–14, a strap in accordance with the present invention is shown consisting of first and second strap members 10, 12 interconnected by a metallic coupling device in the form of an adjustable clasp 14. The strap members are non-metallic and non-expansible. Typical of the strap materials which might be employed are leather or similar hides or skins, cloth fabrics, plastics, or combinations thereof. In the embodiment of FIGS. 1–14, each strap member 10, 12 has a relatively thin top decorative layer 16 of leather or the like, and a thicker bottom supporting layer 18 of a synthetic material such as plastic or the like. In practice, the exposed edges of the strap members are appropriately treated by conventional techniques to provide a uniform attractive appearance.

The clasp 14 is substantially identical to that disclosed in U.S. patent application Ser. No. 908,229 filed May 22, 1978, which is assigned to the same assignee as that of the present invention. Clasp 14 includes a clamp assembly 20 with a hook assembly 22 separably connected thereto. The clamp assembly has a bottom wall 24 with upstanding side walls 26, 28. The bottom wall 24 preferably includes a pronounced somewhat U-shaped notch 30 (see FIG. 3), the purpose of which is to cooperate in increasing the resilience of the side walls 26, 28. The side walls 26, 28 have laterally aligned openings 32, 34 and 36, with the openings 32 being rectangular and relatively large in comparison to the round openings 34, 36. The bottom wall 24 also includes stamped protrusions 38 which can be of any shape, but preferably are somewhat rounded as shown in the drawings.

Figure 5A:
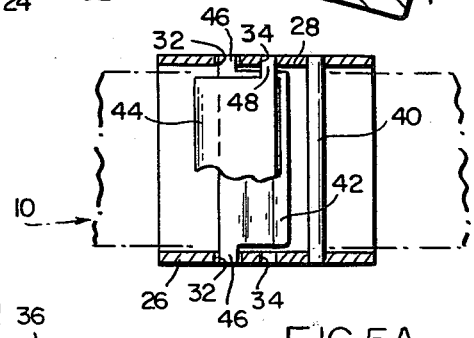
FIG. 5A is a plan view with portions broken away, showing the clamp assembly fixed along the length of the first strap member.

A cross pin 40 extends between the side walls 26, 28 with its opposite ends received in the laterally aligned openings 36. The side walls 26, 28 also support a resilient pressure plate 42 and a pivotal clamp member 44. As is best shown in FIG. 5A, the pressure plate 42 has laterally protruding ears 46 received in the laterally aligned side wall openings 32, and the clamp member 44 has corresponding laterally protruding ears 48 (only one being shown) received in the laterally aligned side wall openings 34.

Figure 4:
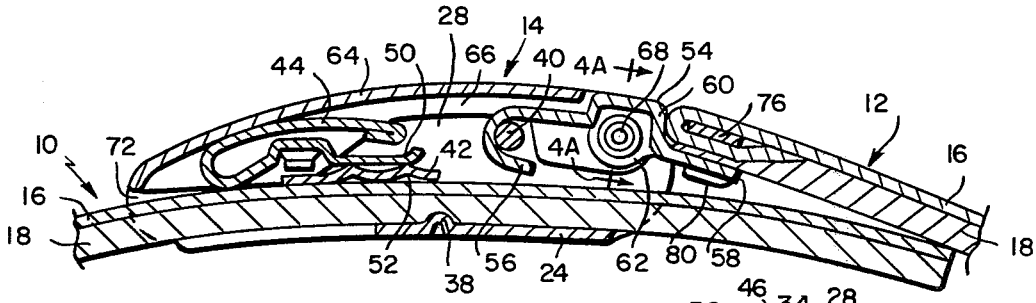
FIG. 4 is a sectional view on an enlarged scale taken along lines 4—4 of FIG. 1.
Figure 5:
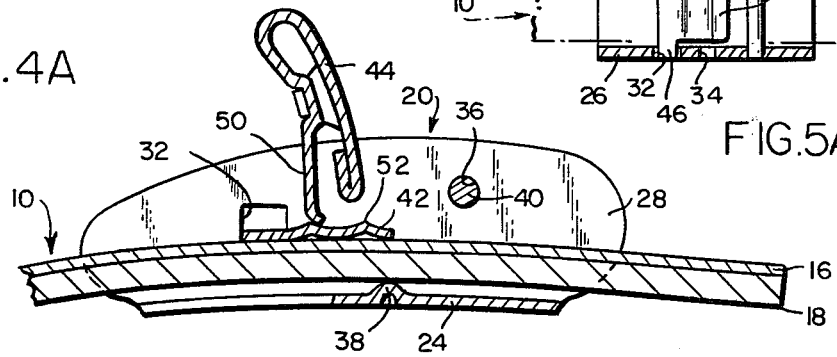
FIG. 5 is a sectional view similar to FIG. 4 of the clamp assembly prior to its being fixed at a selected location along the first strap member.

When the clamp 44 is pivotally raised to its unclamped position as shown in FIG. 5, the first strap member 10 may be inserted between the bottom wall 24 and the pressure plate 42. The clamp assembly then may be slidably adjusted lengthwise on the first strap member to any selected location, at which point the clamp member 44 is pivotally adjusted to its clamped position as shown in FIG. 4. When thus adjusted, a resilient foot 50 on the clamp member 44 acts on a ridge 52 of the pressure plate 42 to resiliently depress the pressure plate, thereby pressing the first strap member 10 against the bottom wall 24. This in turn causes the protrusions 38 to indent into the bottom layer 18 of the strap member, thereby fixing the clamp assembly 20 in place. It will be understood that pivotal adjustment of the clamp member 44 between its clamped and unclamped positions does not require any special tool or implement, and can be performed by the user's finger.

Figure 4A:
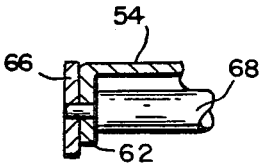
FIG. 4A is a sectional view taken along lines 4A—4A of FIG. 4.

The hook assembly 22 includes an intermediate transversally extending frame member 54 having a forwardly extending hook-shaped nose 56 and a connector element 58 extending rearwardly from an abutment shoulder 60. The frame member 54 is also provided with depending opposed side plates 62 (only one of which is shown in FIG. 4A). A somewhat arcuate cover 64 has side walls 66 which are pivotally connected to the side plates 62 of frame member 54 by means of a transversally extending spring pin 68. The side walls 66 are further provided with laterally protruding stamped bosses 70.

Figure 6:
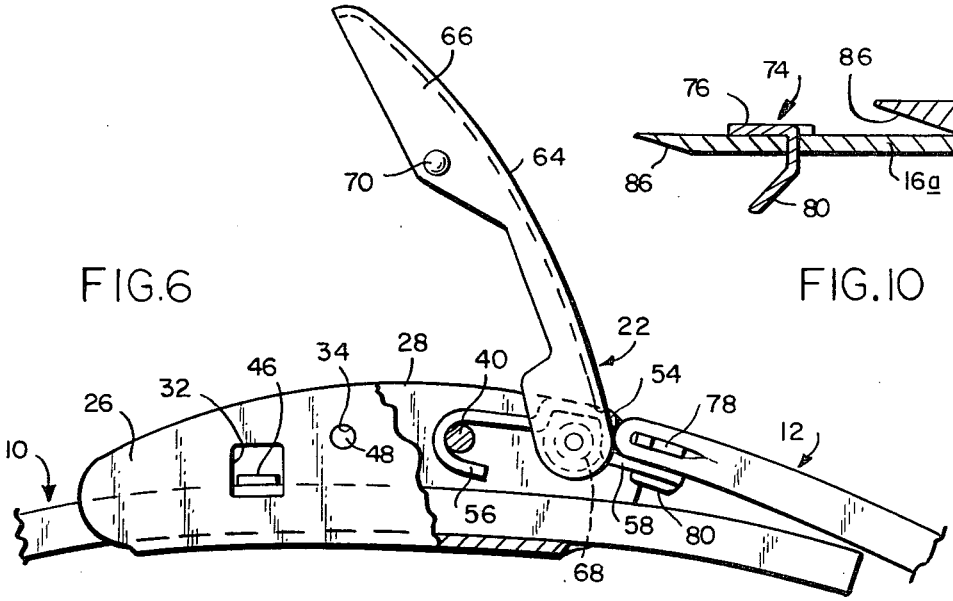
FIG. 6 is a side elevational view, on an enlarged scale, with portions broken away, showing the hook assembly in an intermediate stage of its connection to the clamp assembly.

The hook assembly 22 is separably connected to the clamp assembly 20 by first engaging the hook-shaped nose 56 over the cross pin 40, as shown in FIG. 6. Thereafter, the cover 66 is pivotally closed to locate the cover side walls 66 between the side walls 26, 28 of the clamp assembly. The bosses 70 snap into the upper portions of the rectangular side wall openings 32 to retain the cover in the closed position. A space 72 is provided between the forward edge of cover 64 and the top surface of strap member 10 in order to facilitate insertion of the user's fingernail when opening the cover prior to disconnecting the hook assembly from the clamp assembly.

Figure 7:
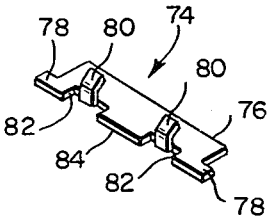
FIG. 7 is a perspective view of the strap adaptor.
Figure 8:
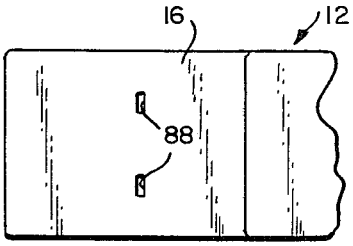
FIG. 8 is a plan view of the second strap member prior to its combination with a strap adaptor.

The rearwardly extending connecting element 58 is adapted to cooperate with a metallic strap adaptor 74 in detachably securing the hook assembly 22 to the second strap member 12. As is best shown in FIG. 7, strap adaptor 74 preferably consists of an integrally formed relatively inexpensive metal stamping having a flat elongated base plate 76 with narrowed ends 78, and with one or more tabs 80 protruding upwardly from notches 82 in the forward plate edge 84. As can best be seen by reference to FIGS. 8–11, one end section 16*a* of the top decorative layer 16 of strap member 12 initially extends beyond the end of the lower layer 18. The ends of both layers are preferably skived as at 86 (see FIG. 10), and end section 16*a* has one or more apertures 88 approximately dimensioned and spaced to receive the tabs 80 of the strap adaptor 74.

Figure 10:
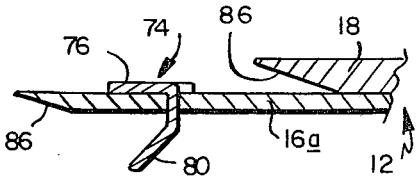
FIG. 10 is a sectional view on an enlarged scale taken along line 10—10 of FIG. 9.
Figure 9:
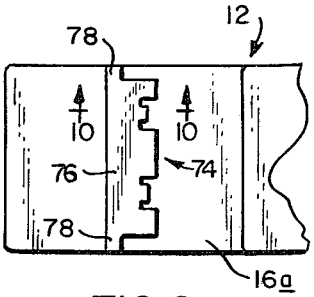
FIG. 9 is a view similar to FIG. 8 showing an intermediate stage in the assembly of the strap adaptor with the second strap member.
Figure 12:
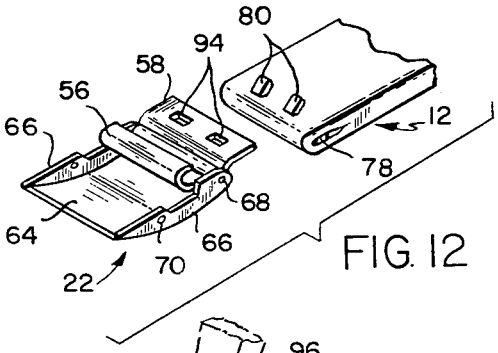
FIG. 12 is a perspective view showing the hook assembly separated from the end of the second strap member.
Figure 11:
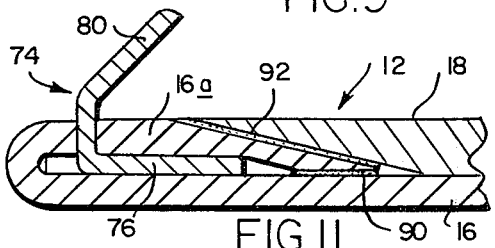
FIG. 11 is a still further enlarged sectional view similar to FIG. 10 showing the strap adaptor permanently connected to the second strap member.

The strap adaptor 74 may be connected permanently to the second strap member 12 by any convenient means which will not detract from the overall decorative appearance of the strap. In a preferred method, the strap adaptor is initially placed transversally across end section 16*a* as shown in FIGS. 9 and 10, with the tabs 80 protruding through the apertures 88. The length of the base plate 76 is substantially equal to the width of strap member 12, and thus the narrowed ends 78 serve as a convenient means of centrally locating the strap adaptor relative to the strap side edges. As shown in FIG. 11, end section 16*a* is then bent around and tucked under the end of the bottom supporting layer 18, thus enveloping the strap adaptor and placing the skived surfaces 86 in opposed relationship. A suitable adhesive is applied as at 90 and 92 to complete the assembly. The strap adaptor 74 is thus permanently secured to the second strap member 12, with the tabs 80 protruding through the apertures 88 in layer 16, and with only the narrowed ends 78 slightly visible, as shown for example in FIG. 6.

The rearwardly extending connector element 58 on the hook assembly 22 is provided with apertures 94 appropriately spaced and dimensioned to receive the tabs 80 when detachably securing the clamp assembly to the second strap member 12. Once inserted through the apertures 94, the tabs 80 are bent into overlapped engagement with the connector element, as shown for example in FIGS. 13 and 14. This bending can be performed with any simple tool, as shown for example by the dot-dash lines at 96 in FIG. 13.

Figure 14:
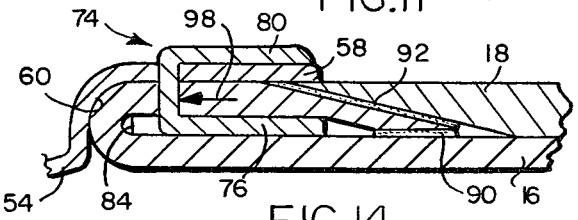
FIG. 14 is a sectional view on an enlarged scale taken along lines 14—14 of FIG. 13.
Figure 13:
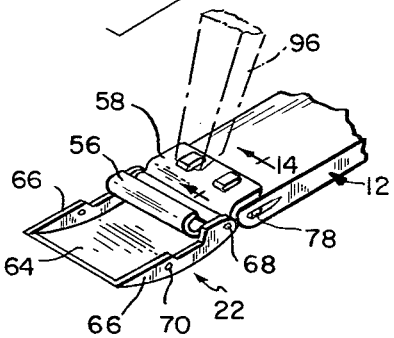
FIG. 13 is a perspective view showing the manner of bendably deforming a tab member to detachably secure the hook assembly to the second strap member.

As the tabs 80 are bent, a force is exerted in the direction of arrow 98 (see FIG. 14). This force urges the end of the second strap member 12 against the abutment shoulder 60 of the frame member 54, and thus provides a continuous decoratively blended look which contributes markedly to the overall attractiveness of the resulting assembly.

Figure 15:
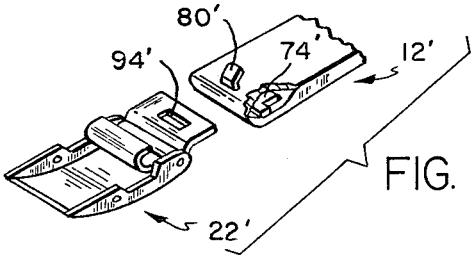
FIG. 15 is a perspective view showing a narrower form of the invention for use with thinner bands.

FIG. 15 shows a slightly modified version of the above-described embodiment, where the second strap member 12' and the hook assembly 22' have been narrowed substantially. Under such circumstances, it may be desirable to employ a single protruding tab 80' on a narrowed strap adaptor 74', and a single aperture 74' in a narrowed connector element 58'.

Figure 16:
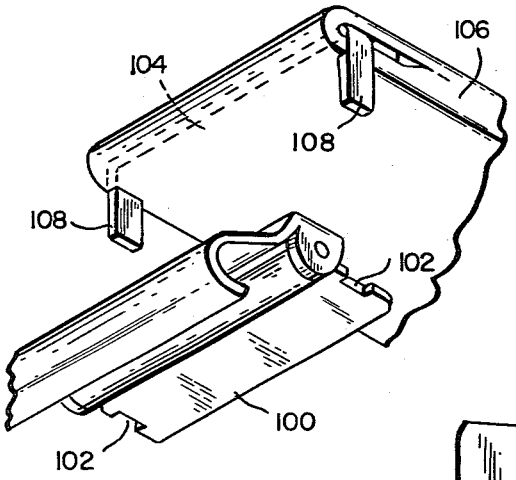
FIG. 16 is a perspective view of an alternate embodiment of the invention, showing a strap member with a modified strap adaptor separated from a modified hook assembly.
Figure 17:
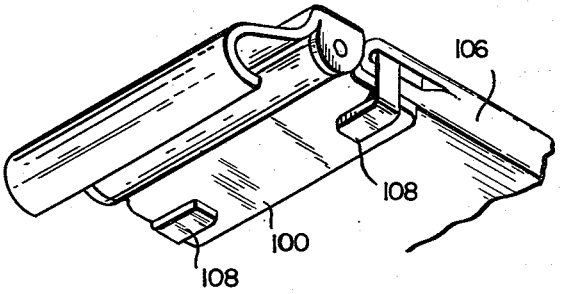
FIG. 17 is a view similar to FIG. 16 showing the strap member detachably secured to the hook assembly.
Figure 18:
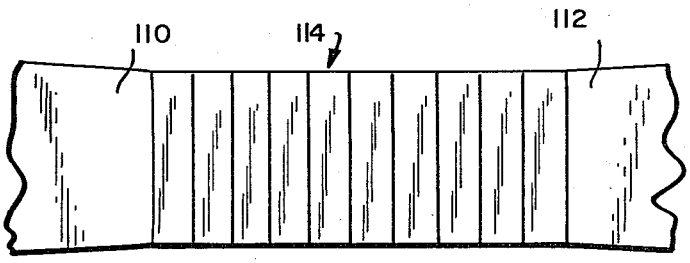
FIG. 18 is a top plan view of another embodiment of the invention wherein the metallic coupling device consists of a short section of expansible linkage.
Figure 19:
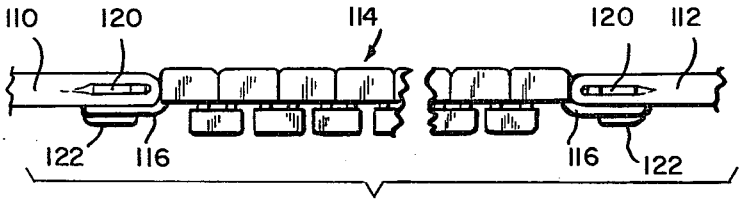
FIG. 19 is a side elevational view of the embodiment shown in FIG. 18.
Figure 20:
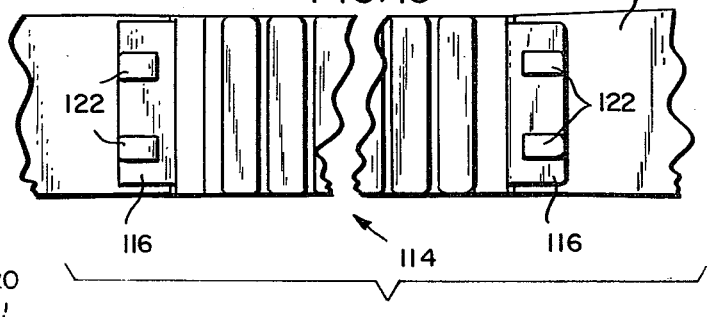
FIG. 20 is a bottom view of the embodiment shown in FIGS. 18 and 19.
Figure 21:
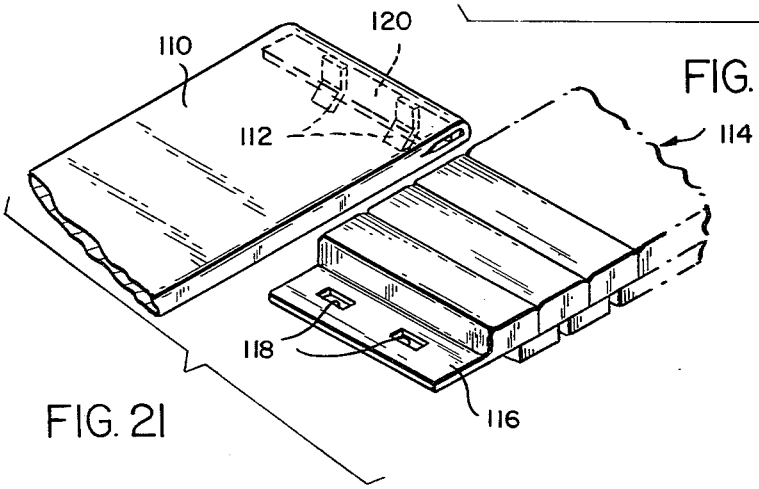
FIG. 21 is a perspective view of a strap member disconnected from the expansible linkage section.

In another embodiment of the invention shown in FIGS. 16 and 17, the rearwardly extending connector element 100 is provided with side notches 102 rather than the apertures of the previously described embodiments. A metallic strap adaptor 104 is again permanently enveloped by or embedded in the end of a second strap member 106. In this arrangement, however, the adaptor 104 has opposed tabs 108 protruding downwardly from its ends. The tabs 108 are received in the notches 102 and are again bent into overlapped engagement with the connector element 100.

In still another embodiment of the invention as shown in FIGS. 18–21, first and second non-expansible non-metallic strap members 110, 112 are interconnected by a metallic coupling device consisting of a short section of expansible linkage 114. Connector elements 116 extend from opposite ends of the linkage section 114, each element being provided with apertures 118. A metallic strap adaptor 120 is enveloped by and permanently secured to one end of each strap member 110, 112. The strap adaptors have protruding tabs 122 which are received in the apertures 118 and which are bendably deformed to overlap the connector elements 116, thereby detachably securing the linkage section 114 between the ends of the strap members 110, 112.

In light of the foregoing, it will now be understood by those skilled in the art that the present invention deals generally with the provision of a strap for attaching a watch or other jewelry article to the wrist of the wearer. The strap includes non-expansible flexible strap members interconnected by a coupling device which is adapted to accommodate adjustment of the overall strap length. Typically, the strap members will be fabricated from non-metallic materials chosen at least in part for their decorative appearance, and the coupling device will be fabricated from metal stampings or the like. In several embodiments disclosed in FIGS. 1–18, the coupling device comprises a clasp assembly including separably connected clamp and hook assemblies. The clamp assembly is slidable lengthwise on and fixable along the length of one of the strap members, thereby permitting the overall length of the strap to be adjusted. The hook assembly is detachably secured to the other strap member by means of a metal strap adaptor permanently fixed thereto. In another embodiment shown in FIGS. 18–21, the coupling device comprises a short length of expansible linkage bracelet of generally known design, with its opposite ends detachably secured to the strap members, again by means of metal strap adaptors. In all embodiments, the strap adaptors have protruding tab means which extend into receiver means in a connector element forming part of the coupling device. The tab means may consist of several tab members arranged either side-by-side as shown in FIGS. 1–14 and 18–21 or in opposed relationship as shown in FIGS. 16–17, and where the width of the assembly so dictates, the tab means can consist of a single tab member as shown in FIG. 15. The receiving means in the connector element can comprise one or more aperture, as illustrated typically in FIGS. 12, 15 and 21, or the receiving means can consist of notches as shown in FIG. 16.

In all embodiments, the tab means extends into the receiving means and is bendably deformed into overlapped engagement with the connector element, thus providing a simple yet efficient detachable connection between the coupling device and an adjacent strap member. With this type of arrangement, worn strap members can be readily replaced without having to also replace the coupling devices.

I claim:

1. A strap for attaching a watch or other jewelry article to the wrist of a wearer, comprising: first and second non-expansible elongated flexible strap members interconnected by a coupling device which is adapted to accommodate adjustment of the overall strap length, at least one of said strap members having a strap adaptor permanently secured thereto, said strap adaptor having tab means protruding therefrom, a connector element forming part of said coupling device, said tab means protruding into receiver means in said connector element and being bendably deformed into overlapped engagement with said connector element to detachably secure said coupling device to the said one strap member.

2. The strap of claim 1 wherein said strap members are non-metallic, and wherein said coupling device and said strap adaptor are metallic.

3. The strap of claim 2 wherein said coupling device includes a clamp assembly slidable lengthwise on and fixable at selected locations along the first strap member, and a hook assembly separably connected to said clamp assembly, with said connector element forming part of said hook assembly.

4. The strap of claim 2 wherein said coupling device consists of a section of expansible linkage, and wherein both ends of said linkage have connector elements cooperating with strap adaptors on both of said first and second strap members to detachably secure said strap members to said linkage.

5. The strap of claim 2 wherein said strap adaptor comprises an elongated flat plate member extending transversally across the said one strap member with the length of said plate member being substantially equal to the width of said one strap member at the location of said plate member, and with said tab means being integral with and protruding above the plane of said plate member.

6. The strap of claim 5 wherein the opposite ends of said plate member are narrowed in width.

7. The strap of claim 5 wherein said strap adaptor is embedded in the end of said one strap member, and wherein said tab means protrudes beyond one surface of the said one strap member.

8. The strap of claim 7 wherein said one strap member consists of at least two superimposed layers, and wherein said strap adaptor is enveloped by at least one of said layers.

9. The strap of claim 1 wherein said receiver means comprises at least one aperture in said connector element.

10. The strap of claim 1 wherein said receiver means comprises notches in oppositely facing edges of said connector element.

11. The strap of claim 1 wherein said connector element has an abutment shoulder against which the end of said one strap member is urged by said adaptor as a result of said tab means being bendably deformed.

12. A coupling device for interconnecting first and second elongated flexible strap members comprising:

a clamp assembly slidable lengthwise on and fixable at selected locations along the first strap member;

a hook assembly separably connected to said clamp assembly;

a strap adaptor fixedly assembled to the second strap member with at least one tab member protruding therefrom;

a connector element on said hook assembly, said connector element having receiver means, said tab member protruding into said receiver means and being bendably deformed to overlap said connector element, thereby detachably securing said hook assembly to the second strap member.

13. The coupling device of claim 12 wherein said strap adaptor is embedded in the end of the second strap member, with said tab member protruding through an aperture in said second strap member.

14. The coupling device of claim 12 wherein said strap adaptor comprises an elongated flat plate member extending transversally across the second strap member with the length of said plate member being substantially equal to the width of the second strap member at the location of said plate member, and with said tab member being integral with and protruding above the plane of said plate member.

15. The coupling device of claim 14 wherein the opposite ends of said plate member are narrowed in width.

16. The coupling device of claim 12 wherein said connector element has an abutment shoulder against which the end of the second strap member is urged by said strap adaptor as a result of said tab member being bendably deformed.

17. For use with a strap having first and second non-expansible non-metallic strap members interconnected by a metallic coupling device, said coupling device having at least one connector element with receiver means integrally formed thereon, means for providing a detachable connection between at least one of said strap members and said connector element comprising a strap adaptor embedded in an end of said strap member, said strap adaptor having at least one tab member protruding outwardly from said one strap member, said tab member being arranged to protrude into said receiver means and being bendably deformable to cooperate in overlapped engagement with said connector element.

18. A strap for attaching a watch or other jewelry article to the wrist of a wearer, comprising:

first and second non-expansible non-metallic elongated flexible strap members;

a metallic clamp assembly slidable lengthwise on and fixable at selected locations along the first strap member;

a metallic hook assembly separably connected to said clamp assembly, said hook assembly having a transverse abutment shoulder with a flat connector element extending therefrom;

a metallic strap adaptor permanently embedded in an end of said second strap member, said adaptor consisting of an elongated flat plate member extending transversally across the second strap member, with the length of said plate member being approximately equal to the width of said second strap member at the said end thereof, said plate member having at least one tab member protruding beyond the exterior of said second strap member;

receiver means in said connector element for receiving said tab member, said tab member being bent into overlapped engagement with said connector element to detachably secure said second strap member to said hook assembly, with the end of said second strap member being drawn tightly against said abutment shoulder.

* * * * *